United States Patent [19]

Kunisada et al.

[11] Patent Number: 4,921,176

[45] Date of Patent: May 1, 1990

[54] APPARATUS FOR CRUSHING THINGS

[75] Inventors: Takeshi Kunisada; Susumu Doumen, both of Nishinomiya; Toshiaki Haga, Kobe, all of Japan

[73] Assignee: Kyokuto Kaihatsu Kogyo, Co., Ltd., Hyogo, Japan

[21] Appl. No.: 191,024

[22] Filed: May 3, 1988

[30] Foreign Application Priority Data

| | | | |
|---|---|---|---|
| May 9, 1987 | [JP] | Japan | 62-113202 |
| May 18, 1987 | [JP] | Japan | 62-120939 |
| May 18, 1987 | [JP] | Japan | 62-120940 |
| Aug. 20, 1987 | [JP] | Japan | 62-206799 |

[51] Int. Cl.[5] ..... B02C 19/22

[52] U.S. Cl. ..... 241/260.1

[58] Field of Search ..... 241/260.1, 261, 235, 241/236; 366/297, 298, 299, 300, 301, 315, 316, 317, 318, 319; 425/204

[56] References Cited

U.S. PATENT DOCUMENTS

| | | | |
|---|---|---|---|
| 308,760 | 12/1884 | Fairman | 241/235 |
| 2,656,122 | 10/1953 | Borner | 241/260.1 |
| 4,191,337 | 3/1980 | Wilson . | |
| 4,717,085 | 1/1988 | Crane | 241/236 |

FOREIGN PATENT DOCUMENTS

| | | | |
|---|---|---|---|
| 0130618 | 1/1985 | European Pat. Off. . | |
| 234842 | 5/1911 | Fed. Rep. of Germany | 241/235 |
| 1062977 | 8/1959 | Fed. Rep. of Germany . | |
| 2240689 | 3/1974 | Fed. Rep. of Germany | 241/235 |
| 2404075 | 7/1975 | Fed. Rep. of Germany . | |
| 2150023 | 3/1973 | France . | |
| 2453672 | 12/1980 | France | 241/235 |
| 48-63389 | 8/1973 | Japan . | |
| 58-500890 | 6/1983 | Japan . | |
| 39721 | 12/1936 | Netherlands | 241/235 |
| 897183 | 1/1982 | U.S.S.R. | 241/235 |
| 1156730 | 5/1985 | U.S.S.R. | 241/236 |

*Primary Examiner*—Mark Rosenbaum

*Attorney, Agent, or Firm*—Wenderoth, Lind & Ponack

[57] ABSTRACT

An apparatus for crushing waste, having two rotating drums mounted substantially at the same level and in parallel with each other in a casing having an inlet and an outlet. The rotating drums are driven by a motor and the rotations thereof are synchronized with each other by gears mounted on the rotating drums, rspectively. A plurality of cutting disks are obliquely fixed to the outer circumferential surface of each of the rotating drums so that each one of the cutting disks of one rotating drum may be substantially parallel with each one of the cutting disks of the other rotating drum when the rotating members have certain phase angles.

4 Claims, 13 Drawing Sheets phase angle = 0° phase angle = 90° phase angle = 180° phase angle = 270°

APPARATUS FOR CRUSHING THINGS

BACKGROUND OF THE INVENTION

The present invention relates to a crusher which crushes things such as waste, wood, plastic and the like, and more particularly, to a crusher which crushes such things utilizing cutting disks.

Japanese Patent Publication (KOHYO) No. 58-500,890 discloses a crusher of this kind. Referring to FIGS. 1 and 2, this crusher is provided with a casing 3 fixed to a base 4 and having an inlet 1 and an inlet 2, screws 5*a*, 5*b*, and 5*c* rotatably mounted in the casing 3 in parallel with each other, and a motor 6 connected to the screws 5*a*, 5*b* and 5*c* for driving the screws 5*a*, 5*b*, and 5*c*. A spiral cutting blade 8*a* is mounted at regular pitches on a circumferential surface of a shaft 7*a* of the first screw 5*a*. A spiral cutting blade 8*b* is mounted at the same pitch as the above-described pitch on a circumferential face of a shaft 7*b* of the second screw 5*b*. A spiral cutting blade 8*c* is mounted at the same pitch as the above-described pitch on a circumferential face of a shaft 7*c* of the third screw 5*c*.

As shown in FIG. 2, waste introduced from the inlet 1 of the casing 3 into the space between the screws 5*a* and 5*b* and between the screws 5*b* and 5*c* is compressed, cut, and shredded by the cutting blades 8*a*, 8*b*, and 8*c*. At this time, the cutting blades 8*a* rotates counterclockwise and the cutting blades 8*b* and 8*c* rotate clockwise. Thereafter, the crushed pieces are discharged from the outlet 2.

However, the crusher has a disadvantage in that the waste is not crushed more than once by the cutting blades 8*a*, 8*b*, and 8*c* while the screws 5*a*, 5*b*, and 5*c* rotate for 360°.

The crusher has another disadvantage in that if the waster includes stiff foreign matter, the foreign matter is sandwiched between the adjacent screws 5*a* and 5*b* and/or between the adjacent screws 5*b* and 5*c*. As a result, the shafts 7*a*, 7*b*, and/or 7*c* may be stopped and this may stop the crushing operation. In addition, part of the screws 5*a*, 5*b*, and/or 5*c* may be broken, which necessitates the replacement of the screw(s).

Another related art is disclosed in Japanese Utility Model Laid-open Publication No. 48-63389. A crusher assembly disclosed therein is provided with a first crusher consisting of crushing rollers or a compressing roller which crushes waste into large pieces. The crusher assembly is also provided with a second crusher consisting of a rotating drum and a fixed blade which crushes the large crushed pieces into small pieces. The first crusher is mounted on an upper portion of the crusher assembly and the second one is mounted on a lower portion thereof. This causes the crusher assembly to be large, so that a large space is required for installing it and further, the crusher may fail easily because it employs many parts.

SUMMARY OF THE INVENTION

It is therefore a first object of the present invention to provide an efficiency-improved crusher which can be manufactured easily and which crushes things, for example, waste, at least twice through the shearing action of opposite rotating members while the opposite rotating members rotate for 360°.

It is a second object of the present invention to provide a crusher in which opposite rotating members are rotated at different speeds so as to facilitate the crushing of waste without setting the opposite rotating members to predetermined phase angles at the beginning of the rotation.

It is a third object of the present invention to prevent the stopping of rotating members during the crushing operation and the breakage of a blade mounted on the rotating member so as to improve the working efficiency.

It is a fourth object of the present invention to provide a crusher which is of a small size and gives rise to few troubles or failures by equipping the crusher with small number of parts.

In order to achieve the first object, an apparatus for crushing things in accordance with the present invention is characterized by the provision of a casing having an inlet and an outlet, of at least two rotating members rotatably mounted in the casing, axes of rotation thereof being in parallel with each other, of means for rotating the rotating members, and of a plurality of cutting disks fixed to an outer circumferential surface of each of the rotating members, the cutting disks fixed to at least one rotating member having a predetermined inclination with respect to the axis of rotation thereof.

The operation of the apparatus is described hereinbelow.

When two rotating members are used, a cutting disk fixed to one of the rotating members and a cutting disk fixed to the other rotating member come up to and pass each other once while the two rotating members rotate for 180° from their initial positions, and again come up to and pass each other while the rotating members rotate for another 180° to return to their initial positions. When the cutting disks pass each other, waste thrown into a space between the rotating members from the inlet of the casing is sheared and crushed. In addition, the following operation is performed by a cutting disk on one rotating member and three adjacent ones on the other rotating member: While the one rotating member rotates for 360° from its initial position, the one cutting disk shears and crushes waste four times at the maximum in combination with either one of the three cutting disks. To be brief, waste is crushed at least twice during one revolution of the rotating members.

An apparatus for crushing things in accordance with the present invention for achieving the second object is characterized by the provision of a casing having an inlet and an outlet, of at least two rotating members rotatably mounted in the casing, axes of rotation thereof being in parallel with each other, of rotating means for rotating the rotating members in opposite directions at different speeds, and of a plurality of cutting disks obliquely fixed to an outer circumferential surface of each of the rotating members so that each one of the cutting disks of one rotating member may be paired with each one of the cutting disks of the other rotating member and that pairs of the cutting disks may be substantially included in respective imagninary planes parallel to each other when the rotating members have certain phase angles.

Further, in order to accomplish the third object of the present invention, an apparatus for crushing things, for example, waste, in accordance with the present invention is characterized by the provision of a casing having an inlet and an outlet, of at least two rotating members rotatably mounted in the casing, axes of rotation thereof being in parallel with each other, of means for rotating the rotating members, of a plurality of cutting disks obliquely fixed to an outer circumferential surface of at least one of the rotating members at predetermined regular intervals so as to have a predetermined inclination with respect to the axis of the rotating member, and of a screw fixed to an outer circumferential surface of the outer rotating member.

The operation of the above apparatus is described hereinbelow.

When two rotating members are used, waste thrown into the apparatus from the inlet is disposed between the rotating members. At this time, forces oriented in opposite directions are applied to the waste by both the screw and the cutting disks, whereby the waste is compressed and crushed. Thereafter, the crushed waste is discharged from the outlet.

If still foreign matter is caught between the screw and the cutting disks when inclined in one direction, there is no problem because the direction of the inclination of the cutting disks is reversed when the cutting disks have rotated 180° from that point, resulting in the release of the foreign matter from the compression by the screw and cutting disk, followed by the discharge thereof from the outlet. Thus, the crushing operation continues without stopping of the rotating members.

Furthermore, in order to achieve the fourth object, an apparatus for crushing waste in accordance with the present invention is characterized by the provision of a casing having an inlet and an outlet, of at least two rotating members rotatably mounted in the casing, axes of rotation thereof being in parallel with each other, of means for rotating the rotating members, of a plurality of cutting disks obliquely fixed to an outer circumferential surface of at least one of the rotating members at predetermined regular intervals so as to have a predetermined inclination with respect to the axis of the rotating member, of a screw fixed to an outer circumferential surface of the other rotating member, of blades spirally fixed to the outer circumerential surface of the other rotating member in such a manner that the blades intersect the screw, and a stationary blade fixed to an inner surface of the casing so as to confront the other rotating member, whereby a crushing operation is performed by the cutting disks and the screw, followed by a further crushing operation performed by the blades on the other rotating member and the stationary blade.

The operation of the above apparatus is described hereinbelow.

When two rotating members are used, one for the cutting disks and the other for the screw, waste thrown into and between the two rotating members is compressed and crushed into large pieces by the cutting disks and the screw. Thereafter, the large pieces of the waste are compressed and crushed into small pieces by the blades fixed to the other rotating member and the stationary blade.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF PREFERRED EMBODIMENTS

First Embodiment

Figure 1:
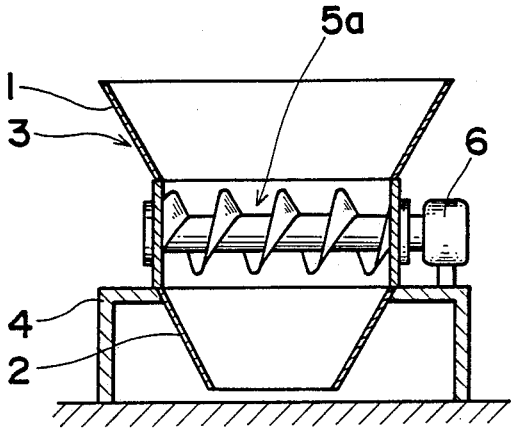
Fig. 1 PRIOR ART
FIGS. 1 and 2 are vertical sectional and plan views showing a conventional crusher.
Figure 2:
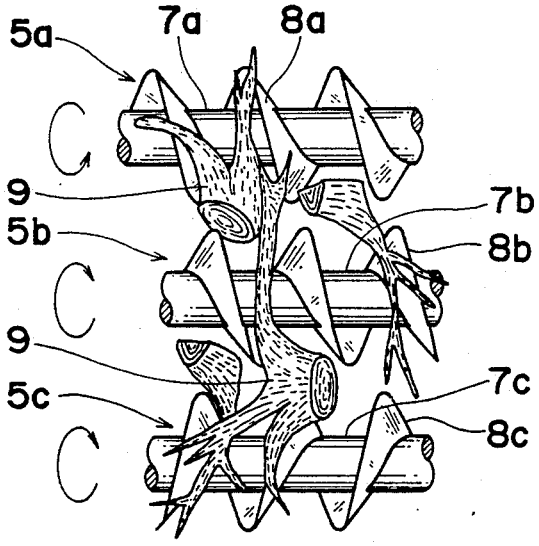
Fig. 2 PRIOR ART

A first embodiment of the present invention is described with reference to FIGS. 3 through 9.

An apparatus for crushing waste of the first embodiment is characterized in that it comprises a casing 11 having an inlet 12 and an outlet 14, at least two rotating members 15 and 16 rotatably mounted in the casing 11, axes of rotation thereof being in parallel with each other; means 17, 18 and 21 for rotating the rotating members; and a plurality of cutting disks 25 fixed to an outer circumferential surface of each of the rotating members 15 and 16, the cutting disks 25 fixed to at least one rotating member 15 having a predetermined inclination (at an angle other than 90°) with respect to the axis of rotation thereof.

Figure 4:
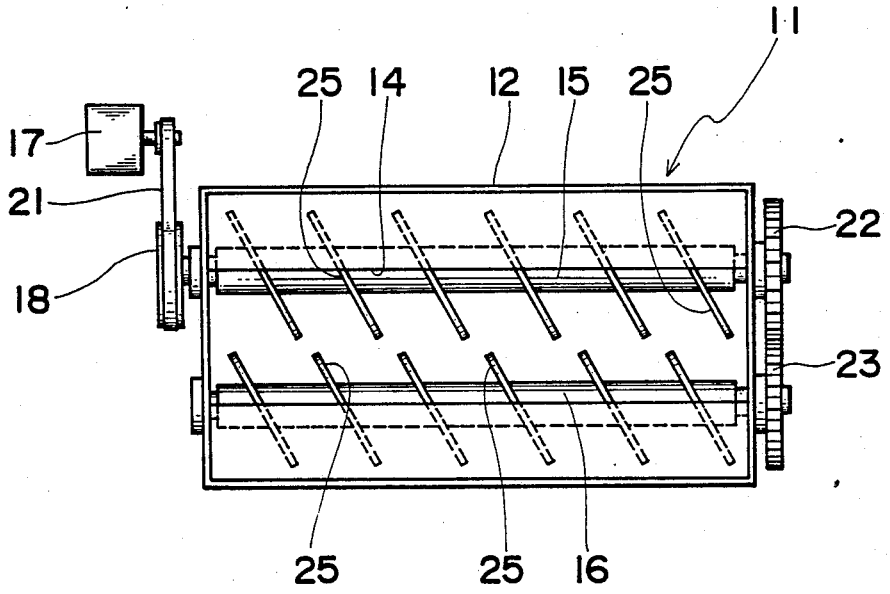
FIG. 4 is a plan view showing a crusher of a first embodiment of the present invention.
Figure 5:
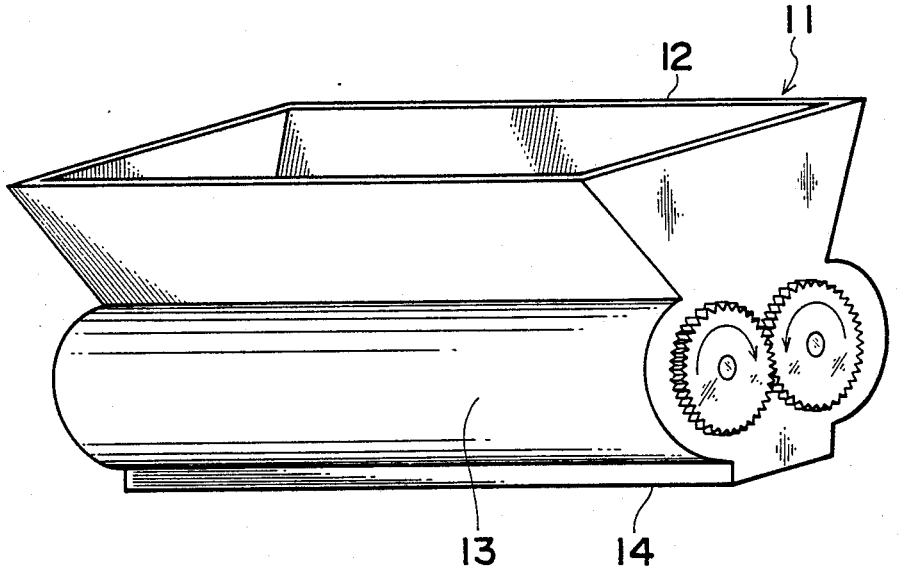
FIG. 5 is a perspective view of the crusher of the first embodiment.

Referring to FIGS. 4 and 5, a casing 11 has an inlet 12 and an outlet 14, and a pair of rotating drums 15 and 16 comprising pipes or tubes serving as rotating members are mounted therein. The rotating drum 15 is rotated by a drive motor 17.

As shown in FIG. 5, the inlet 12 is funnel-shaped and sectionally rectangular and the outler 14 is also sectionally rectangular. Both side portions of the crushing portion 13 disposed between the inlet 12 and the outlet 14 are semicylindrical. The rotating drums 15 and 16 are disposed in the same horizontal plane and parallel with each other in the crushing portion 13. The rotating drums 15 and 16 are supported by bearings mounted on both ends of the casing 11. Both ends of the rotating drum 15 project outward from the casing 11 in opposite directions. A pulley 18 is fixed to one of the ends of the rotating drum 15. A belt 21 is spanned between the pulley 18 and another pulley connected to the motor 17. A gear 22 is fixed to the other end of the rotating drum 15. A gear 23 having the same number of teeth as the gear 22 is fixed to the end of the rotating drum 16 projecting from the casing 11. The gear 23 engages with the gear 22, whereby the rotating drums 15 and 16 rotate at the same speed in synchronization with each other.

Figure 3:
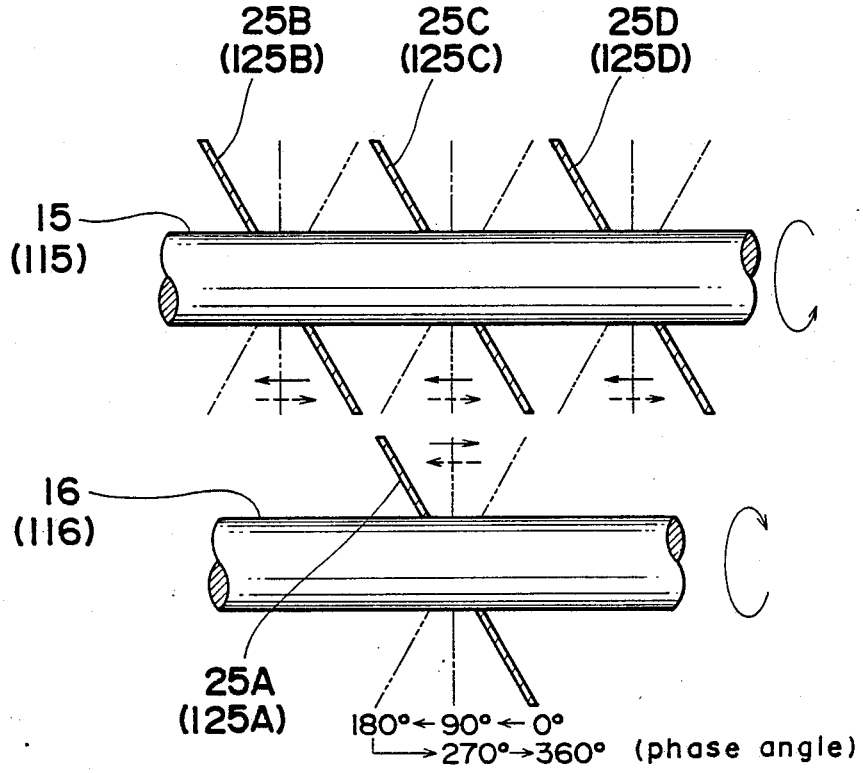
FIG. 3 is an explanatory diagram showing a crushing principle of cutting disks while rotating members of the present invention rotate for 360°.
Figure 6:
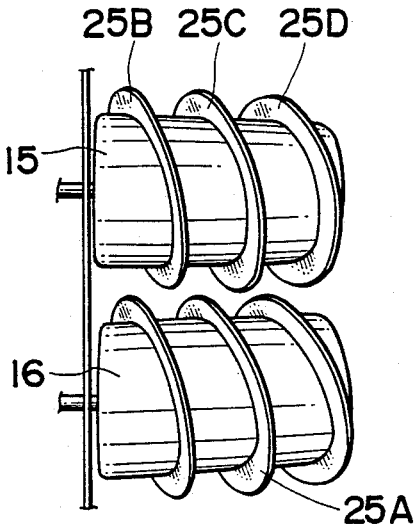
FIGS. 6 through 9 are illustrations showing the positional relation between cutting disks on two rotating members at the phase angles of 0°, 90°, 180°, and 270° of rotating members.
Figure 7:
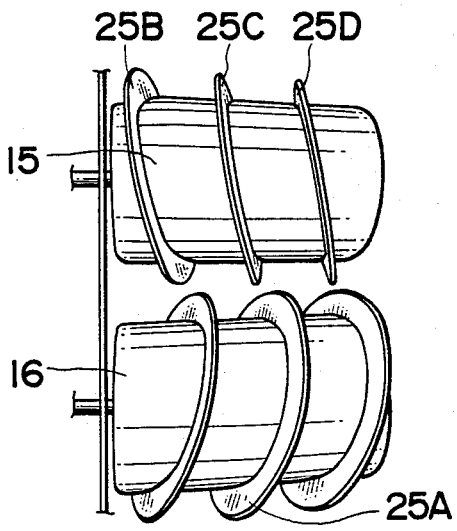
Figure 8:
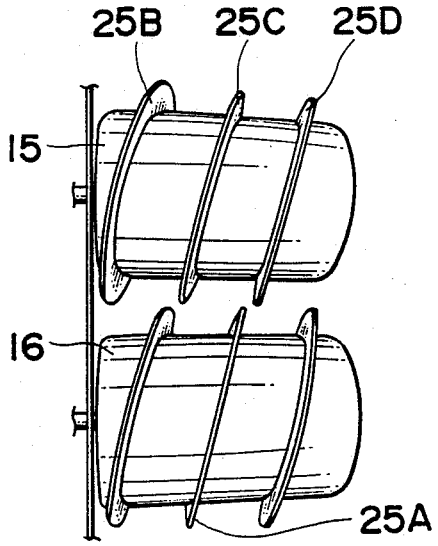
Figure 9:
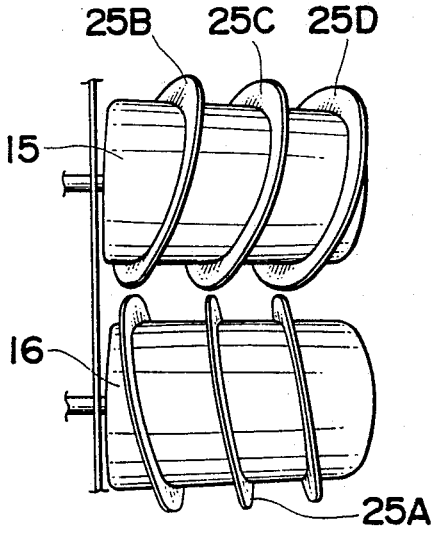

A plurality of disk-shaped cutting plates or cutting disks 25 are welded to the outer circumferential surfaces of the rotating drums 15 and 16 in such a manner that the cutting disks are disposed at regular intervals and at a predetermined inclination relative to the rotating drums 15 and 16, respectively so that the cutting disks incline in parallel with each other. As shown in FIGS. 3, 4, and 6, pairs of cutting disks 25 of the rotating drums 15 and 16 are in substantially a common plane when the phase angles of the rotating drums 15 and 16 are 0°, and at that phase angle a slight gap is provided between the opposing cutting disks 25 of each pair. A slight gap is also provided between the cutting disks 25 of the rotating drums 15 and 16 and the inner peripheral surface of the crushing portion 13 of the casing 11. The peripheral edge of the lower end of the opening of the inlet 12 is provided inwardly of the axes of the rotating drums 15 and 16 which rotate in opposite directions as shown by the arrows in FIGS. 3 and 5 so that waste such as pieces of wood or the like thrown into the casing 11 through the opening is introduced into only the space between the rotating drums 15 and 16 and not introduced into the space between the rotating drum 15 and the casing 11 and/or between the rotating drum 16 and the casing 11. Accordingly, the casing 11 is not subjected to force which would be otherwise applied thereto from the waste.

Next, the operation of the crusher with the above-described construction is described with reference to FIG. 3. First, only the operation of a pair of cutting disks 25A and 25C is described. Assume that the pair of cutting disks 25A and 25C lie in planes which are spaced apart and parallel with each other when the phase angles of the rotating drums 16 and 15 are 0° and that the rotating drums 15 and 16 start rotating in opposite directions from that position while the rotating drums 16 and 15 rotate for 180°, the portions of the cutting disk 25A and the cutting disk 25C facing each other approach and pass each other, thus crushing the waste. Thereafter, the portions of the cutting disks 25A and 25C facing each other rotate away from each other. While the cutting disks 25A and 25C rotate for another 180°, namely, when the phase angles thereof are in the range from 180° to 360°, the cutting disks 25A and 25C come up to and pass each other again, thus crushing the waste. Thus, the waste is crushed twice by the cutting disks 25A and 25C while the rotating drums 15 and 16 rotate for 360° for one revolution. When the cutting disk 25C of the rotating drum 15 is pressing the waste in one direction, the cutting disk 25A of the rotating drum 16 is pressing the waste in the opposite direction. Accordingly, the force applied to the waste is offset, so that no force is applied to the end faces of the casing 11. That is, the wall of the casing 11 can be formed to be thin.

The crushing operation effected by the cutting disk 25A in combination with three cutting disks 25B, 25C, and 25D is described hereinafter. As shown in FIG. 3 and FIGS. 6 through 9, when the phase angle of the rotating drums 15 and 16 is in the range from 0° to 90°, that is, when the rotating drums rotate for 90° from the initial position, the cutting disks 25A and 25C approach and pass each other, crushing the waste (first crushing). When the rotating drums 15 and 16 rotate for another 90° (90°–180°), the cutting disks 25A and 25C rotate away from each other. During this period of time, the portions of the cutting disks 25A and 25D facing each other come up to each other and crush the waste (second crushing). When the rotating drums 15 and 16 rotate for another 90° from the position of the phase angle of 180° (180°–270°), the cutting disks 25A and 25D rotate away from each other while the cutting disks 25A and 25C come up to and pass each other, thereby crushing the waste (third crushing). Finally, when the rotating drums 15 and 16 rotate for another 90° from the position of the phase angle of 270° (270°–360°), the cutting disks 25A and 25C rotate away from each other while the portions of the cutting disks 25A and 25B facing each other approach and pass each other, and crush the waste (fourth crushing). Thus, the waste is crushed four times during one revolution of the rotating drums 15 and 16.

As apparent from the foregoing description, the crusher of this embodiment crushes the waste at least twice per rotation of the rotating drums, and improves crushing efficiency. Further, the disk-shaped cutting plates 25 can be more easily manufactured at a lower cost and more easily fixed to the rotating drums 15 and 16 than screw blades.

In this embodiment, the rotating drums 15 and 16 are synchronously rotated and each pair of opposite cutting disks 25 fixed to the respective rotating drums 15 and 16 are included in substantially the same plane at the phase angle of 0°. However, the rotating drums 15 and 16 may be rotated at desired speeds independently of each other by individual motors. Further, the cutting disks 25 and 25 may be mounted on the rotating drums 15 and 16 at any desired angles with respect thereto.

Second Embodiment

Figure 10:
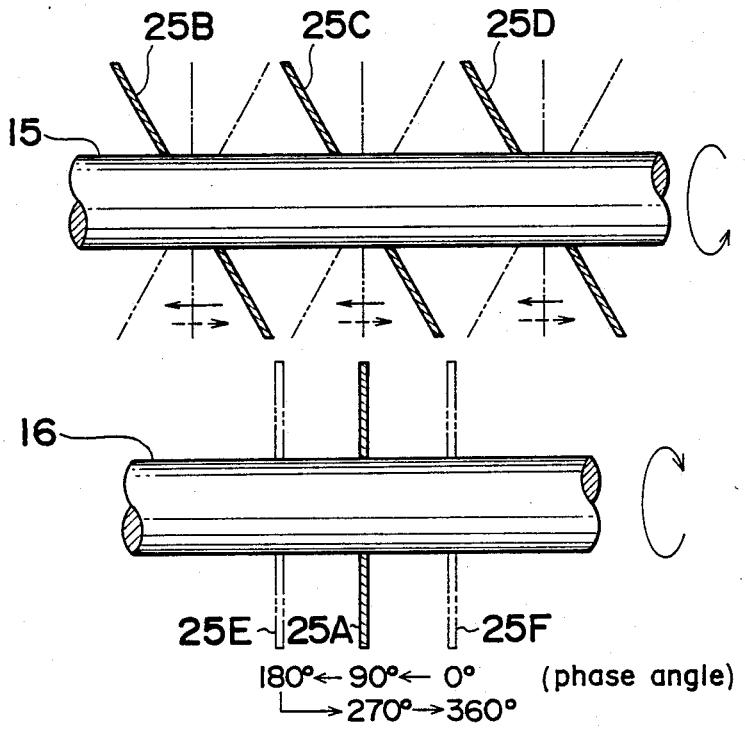
FIG. 10 is an explanatory diagram showing a crushing principle of the cutting disks of a second embodiment of the present invention.
Figure 11:
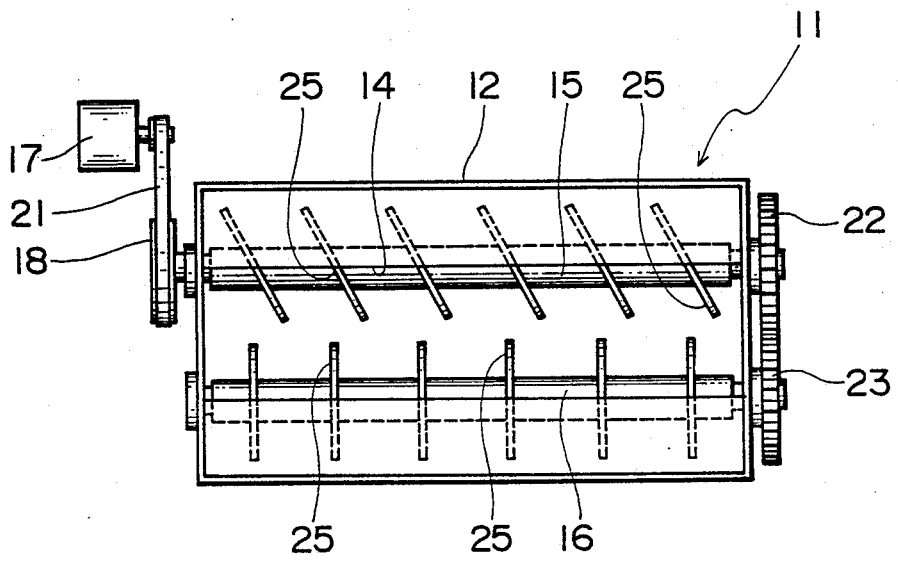
FIG. 11 is a plan view showing a crusher of the second embodiment.

The second embodiment is described with reference to FIGS. 10 and 11. In these drawings, like parts are designated by like reference numerals and further detailed description of such parts is here omitted. The second embodiment differs from the first embodiment in the following respect. That is, in the first embodiment, all the cutting disks 25 are fixed to the rotating drums 15 and 16 so that they are disposed in respective common imaginary planes parallel to each other, when the phase angles of the rotating drums 15 and 16 are 0°, whereas in the second embodiment, the cutting disks 25 mounted on the rotating drum 16 are at right angles to the axis thereof. As shown in FIG. 10, the positions at which the cutting disks 25 (25A) are mounted on the rotating drum 16 correspond to intersections of the axis of the rotating drum 15 and the respective cutting disks 25 (25B, 25C, 25D) mounted thereon.

The operation of the cutting disks 25 of the above-described construction are described with reference to FIG. 10. During the rotations of the rotating drums 15 and 16 in opposite directions, the cutting disk 25A fixed to the rotating drum 16 always rotates only in the one vertical plane. Accordingly, the cutting disk 25C approaches the cutting the cutting disk 25A and crushes the waste when the phase angle of the cutting disk 25C develops from 0° to 90° and from 180° to 270°. Thus, the waste is crushed twice during rotations of the rotating drums 15 and 16.

The crusher operates more efficiently if the number of the cutting disks 25 to be fixed to the rotating drum 16 is increased. For example, a cutting disk 25F may be mounted on the rotating drum 16 so that a peripheral portion of the cutting disk 25F on the rotating drum 16 may confront a peripheral portion of the cutting disk 25C on the rotating drum 15 at the phase angle of 0°. As shown in FIG. 10, during a rotation of the cutting drum 15, the cutting disk 25C approaches closest to the cutting disk 25A at the phase angle of 90°, to a cutting disk 25E at the phase angle of 180°, to 25A again at the phase angle of 270°, and to 25F at the phase angle of 360°, thereby crushing the waste four times per rotation of the rotating drums 15 and 16.

The rotating drums 15 and 16 are rotated in opposite directions by the gears 22 and 23 in this embodiment. However, the same crushing efficiency can be obtained even when the rotating drums 15 and 16 are rotated in the same direction by a belt (not shown).

Third Embodiment

A third embodiment is described with reference to FIGS. 12 through 17. A crusher of this embodiment is an improvement of the first embodiment. In the first embodiment, pairs of opposite cutting disks 25 fixed to the respective rotating drums 15 and 16 are in common planes parallel to each other at the phase angle of 0° of the rotating drums. However, if one of the rotating drums starts its rotation from the phase angle of 180° instead of 0° because of a misinstallation of the rotating drum, for example, the cutting disks 25 and 25 of the opposite rotating drums 15 and 16 only transfer a waste to the right and left in cooperation with each other without compressing and crushing the waste.

The third embodiment to solve this problem is characterized in that it comprises a casing 111 having an inlet 112 and an outlet 114, at least two rotating members 115 and 116 rotatably mounted in the casing 111, axes of rotation thereof being in parallel with each other, means 117, 118 and 121 for rotating the rotating members 115 and 116 in opposite directions at different speeds, and a plurality of cutting disks 125 obliquely fixed to an outer circumferential surface of each of the rotating members 115 and 116 so that each one of the cutting disks 125 of one rotating member 115 may be paired with each one of the cutting disks 125 of the other rotating member 116 and that pairs of the cutting disks 125 may be included in respective imaginary planes parallel to each other when the rotating members 115 and 116 have certain phase angles.

Figure 12:
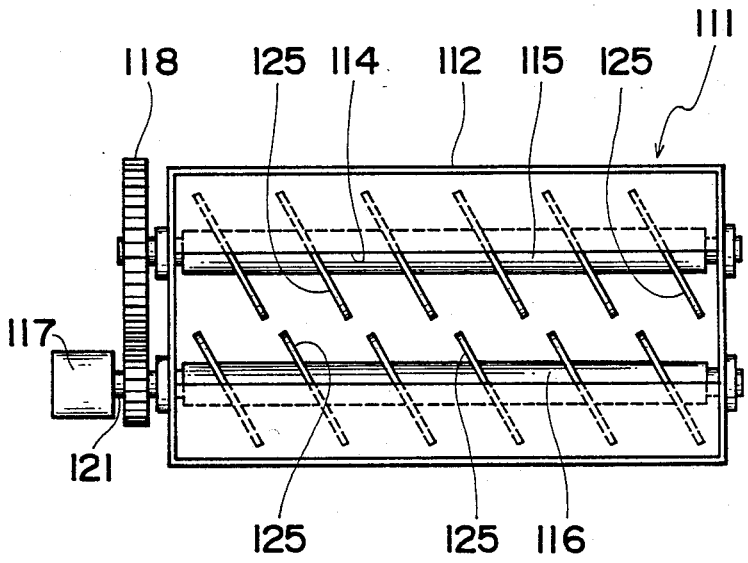
FIG. 12 is a plan view showing a crusher of a third embodiment.
Figure 13:
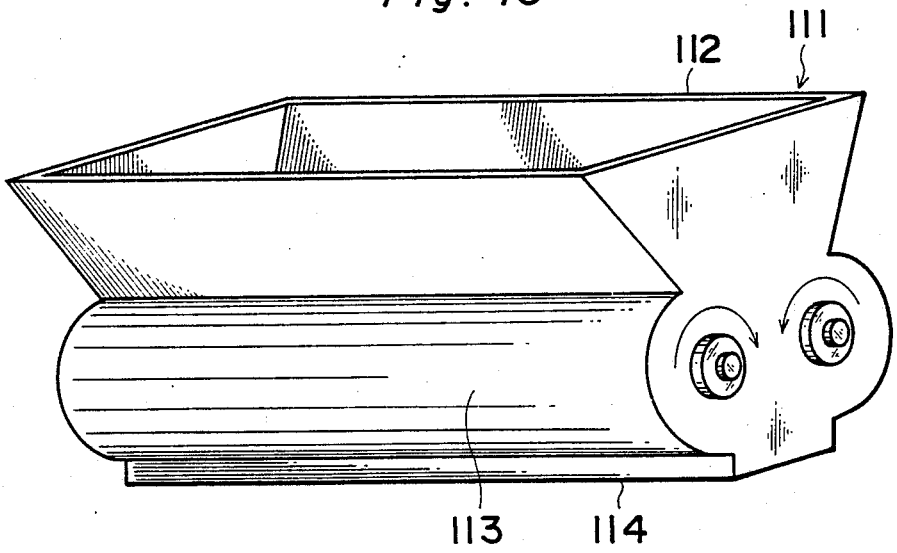
FIG. 13 is a perspective view showing the crusher of the third embodiment.

Referring to FIGS. 12 and 13, a casing 111 has an inlet 112 and an outlet 114 and a pair of rotating drums 115 and 116 serving as rotating members are mounted therein.

The inlet 112 is funnel-shaped and sectionally rectangular and the outlet 114 is also sectionally rectangular. Both side portions of a crushing portion 113 disposed between the inlet 112 and the outlet 14 are semicylindrical. The rotating drums 115 and 116 are disposed in the same horizontal plane and in parallel with each other in the crushing portion 113. The rotating drums 115 and 116 are rotatably supported at their end portions by bearings mounted on both ends of the casing 111. One of the ends of each rotating drum 15 and 16 projects outward from the casing 111. A larger gear 118 is mounted on the projecting end of the rotating drum 115, and a smaller gear 121 engaging with the larger gear is mounted on the projecting end of the rotating drum 116. The rotating drums 115 and 116 are rotated in opposite directions by the engagement of the larger gear 118 and the smaller gear 121 which is driven by a hydraulic motor 117. The diameter of the larger gear 118 is twice as great as that of the smaller gear 121.

Figure 15:
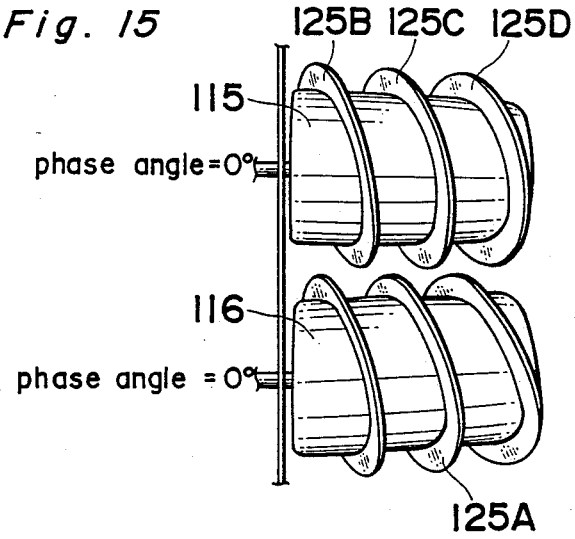
Figure 16:
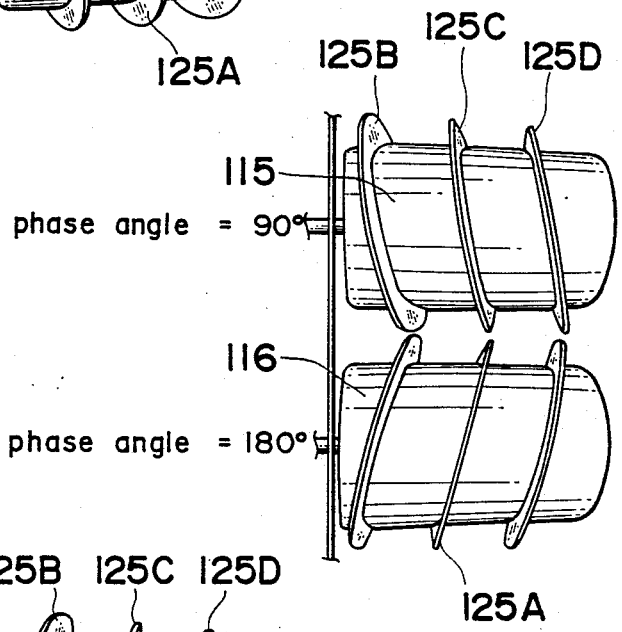
Figure 17:
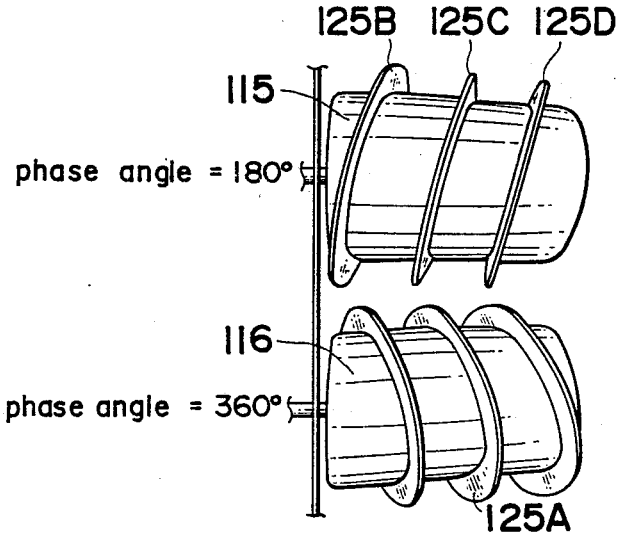

A plurality of cutting disks 125 are obliquely welded to an outer circumferential surface of each of the rotating drums 115 and 116, so that, as shown in FIGS. 3, 12 and 15, each one of the cutting disks 125 (e.g., 125B) of the rotating drum 115 is paired with each one of the cutting disks 125 (e.g., 125A) of the rotating member 116 and that pairs of the cutting disks 125 (e.g., 125A and 125B) may be included in respective imaginary planes parallel to each other when the rotating drums 115 and 116 each have the phase angle of 0°. There is a slight gap between the facing outer circumferential surfaces of the cutting disks 125 included in either common imaginary plane. There is also a slight gap between the cutting disks and an inner surface of the casing at a crushing portion 113. An opening of the inlet 112 is provided in a central portion corresponding to a space between the axes of the rotating drums 115 and 116 which rotate in opposite directions as shown by the arrows in FIGS. 3 and 13 so that waste such as wood or the like thrown into the casing 111 through the opening is introduced only into the space between the rotating drums 115 and 116 and not introduced into the space between the rotating drum 115 and the casing 111 and between the rotating drum 116 and the casing 111. Accordingly, the casing 111 is not subjected to force which would be otherwise applied thereto from the waste.

Figure 14:
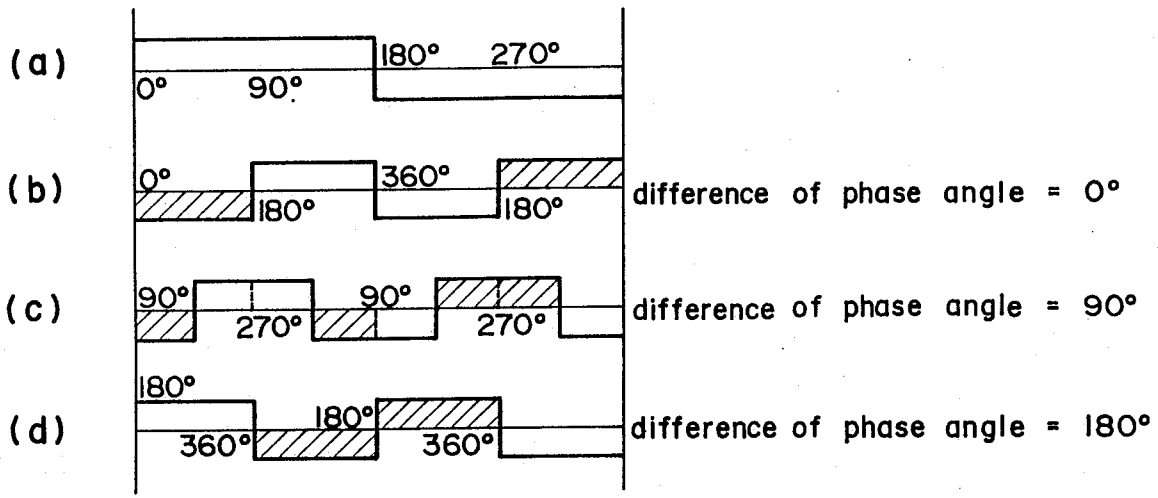
FIGS. 14 through 17 are illustrations showing the crushing principle of the cutting disks of the third embodiment.

The operation of the crusher having the above-described construction is described referring to FIGS. 3 and 14. Referring to FIG. 14, (a) illustrates a periodic motion of a cutting disk 125 on the rotating drum 115, and (b), (c) and (d) each illustrate that of a corresponding cutting disk on the rotating drum 116. Timing of crushing or shearing can be known by the combination of (a) and (b) or (c) or (d). Crushing operation is effected in a region corresponding to a hatched portion in the drawing.

Waste crushing by the cutting disks 125A and 125C is taken as an example here. Assume that the phase angles of the rotating drums have been set to 0° at which the cutting disks 125A and 125C are parallel to each other. Now waste is thrown between these cutting disks and the hydraulic motor 117 is started to rotate the rotating drums 115 and 116 in opposite directions at the speed ratio of 1:2. Therefore, when the rotating drum 115 rotates for 180°, the rotating drum 116 rotates for 360°. While the waste placed between the cutting disks 125A and 125C is put into motion by the cutting disk 125A in the direction shown by the arrow of a solid line shown in FIG. 3, it is forced to reciprocate by the cutting disk 125C in the directions shown by the arrows of solid and broken lines shown in FIG. 3. During this period, as shown in FIG. 14(*a*) showing the operation of the cutting disk 125A and in FIG. 14(*b*) showing the operation of the cutting disks 125C, the cutting disk 125A and the cutting disk 125C approach and pass each other, crushing the waste once. When the rotating drum 115 rotates for another 180° from the phase angle of 180°, the cutting disks 125A and the cutting disk 125C come up to and pass each other once, when they shear the waste. That is, per rotation of the rotating drum 115, the waste is crushed twice and discharged from the outlet 114 of the casing 111.

Now, assume that a crushing operation starts with the phase angles of the rotating drums 115 and 116 different by 90° from each other. As shown in FIG. 3, FIG. 14(*a*) and FIG. 14(*c*), when the rotating drum 115 rotates for 90° from the phase angle of 0°, the rotating drum 116 rotates for 180° from the phase angle of 90° to 270°. During this rotation, the cutting disk 125A and the cutting disk 125C pass each other once in the hatched portion. When the rotating drum 115 rotates for another 90° from the phase angle of 90°, the rotating drum 116 rotates for another 180° from the phase angle of 270° to 90°. During this period, the cutting disk 125C and the cutting disk 125A pass each other once. Thereafter, while the rotating drum 115 rotates 180° from the phase angle of 180° and the rotating drum 116 rotates 360° from the phase angle of 90°, the cutting disk 125A and the cutting disk 125C pass each other once in the hatched portion. That is, the waste is crushed three times per rotation of the rotating drum 115.

Next, assume that a crushing operation starts with the phase angles of the rotating drums 115 and 116 different by 180° from each other. When the rotating drum 115 rotates for 180° from the phase angle of 0°, the rotating drum 116 rotates for 360° from the phase angle of 180° to return to the phase angle of 180°. During this rotation, the cutting disk 125C catches up with the cutting disk 125A and then, both cutting disks 125C and 125A approach and pass each other, effecting a crushing. When the rotating drum 115 rotates for 180° from the phase angle of 180°, the rotating drum 116 rotates for 360° from the phase angle of 180°, and during this rotation the cutting disk 125C and the cutting disk 125A come up to and pass each other again. Thus, in this case, the waste is crushed two times per rotation of the rotating drum 115.

As apparent from the foregoing description, if a crushing operation starts with the phase angles of the rotating drums 115 and 116 different from each other, no operation for modifying or correcting the difference of the phase angles is necessary. Thus, a crushing operation becomes easy.

The speed ratio between the two rotating drums is 1:2 in this embodiment. However, various speed ratios such as 1:1.25, 1:3, for example, may be adopted, i.e., an efficient crushing operation can be performed only by rotating the rotating drums at different speeds because the difference of the rotating speeds between the rotating drums makes the corresponding cutting disks on the rotating drums pass each other. Only one hydraulic motor is used to rotate both the rotating drums through the gears in this embodiment; however, two hydraulic motors may be provided to drive the rotating drums separately.

In accordance with this embodiment, even if the positional relation between the cutting disks of one rotating drum and the cutting disks of the other rotating drum varies, that is, a crushing operation starts with the phase angle of either of the rotating drums changed from the initial value, namely, 0°, the waste can be crushed without performing any operations to turn the rotating drum(s) back to the initial position(s). Thus, a crushing operation can be accomplished easily.

Fourth Embodiment

A fourth embodiment is shown in FIGS. 18 to 21.

A crusher of this embodiment is characterized in that is comprises a casing 201 having an inlet 202 and an outlet 203, at least two rotating members 204 and 214 rotatably mounted in the casing 201, axes of rotation thereof being in parallel with each other, means 206 and 216 for rotating the rotating members, a plurality of cutting disks 208 obliquely fixed to an outer circumferential surface of at least one of the rotating members 204 and 214 such as rotating member 204 at predetermined regular intervals so as to have a predetermined inclination with respect to the axis of the rotating member 204, and a screw 207 fixed to an outer circumferential surface of the other rotating member 214.

Figure 18:
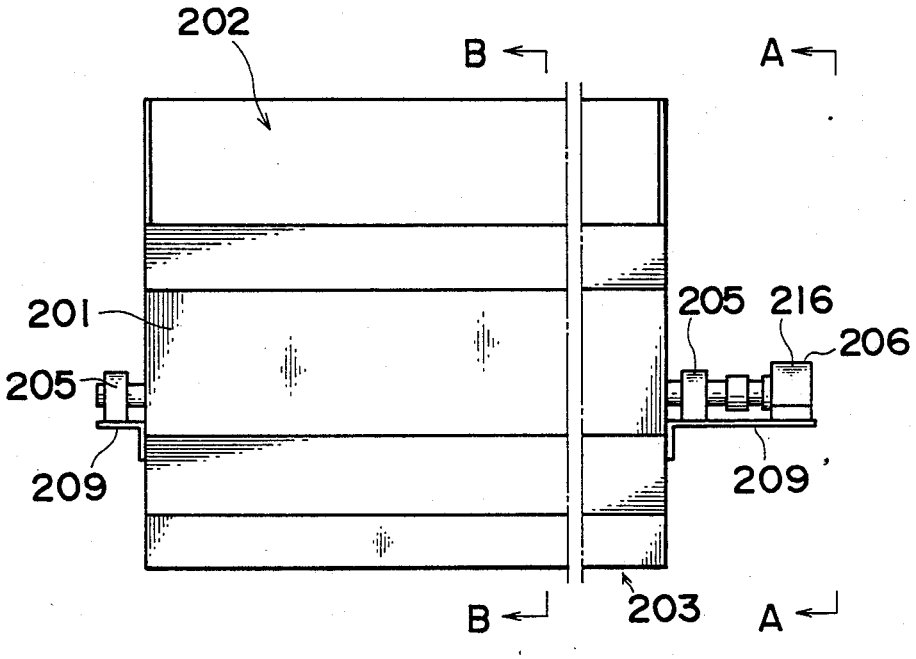
FIG. 18 is a front view of a crusher of a fourth embodiment of the present invention.
Figure 19:
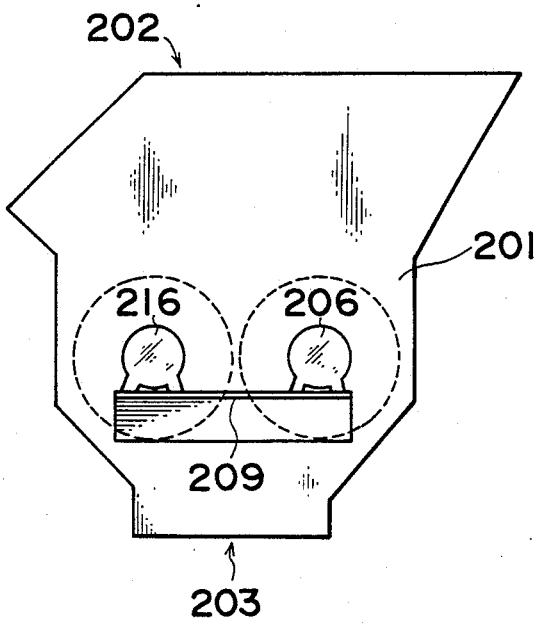
FIG. 19 is a view taken along the line A—A shown in FIG. 18.

Referring to FIGS. 18 and 19, a casing 201 has an inlet 202 on the upper portion thereof and an outlet 203 on the lower portion thereof.

Figure 20:
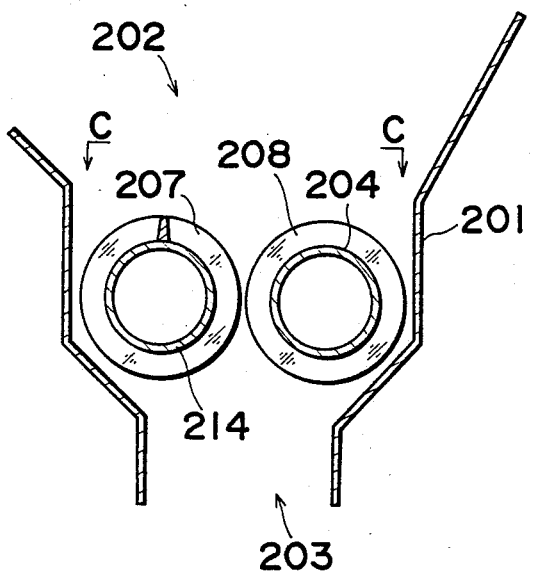
FIG. 20 is a cross-sectional view taken along the line B—B shown in FIG. 18.

As shown in FIGS. 18 and 20, a pair of rotating drums 204 and 214 serving as the rotating members are mounted in the casing 201 in parallel with each other and in the same imaginary horizontal plane. The rotating drums 204 and 214 are supported by bearings 205 and 205 at end portions thereof, and rotated in opposite directions by motors 206 and 216, respectively.

A screw 207 is mounted on the rotating drum 214. Waste is transferred along the rotating drum 214 toward the right in FIG. 21 by the rotating of the rotating drum 214.

A plurality of parallel cutting disks 208 are fixed to the rotating drum 204 with a space between adjacent cutting disks and obliquely with respect to the rotating drum 204. The outer periphery of each of the cutting disks 208 is close to the screw 207.

Figure 21:
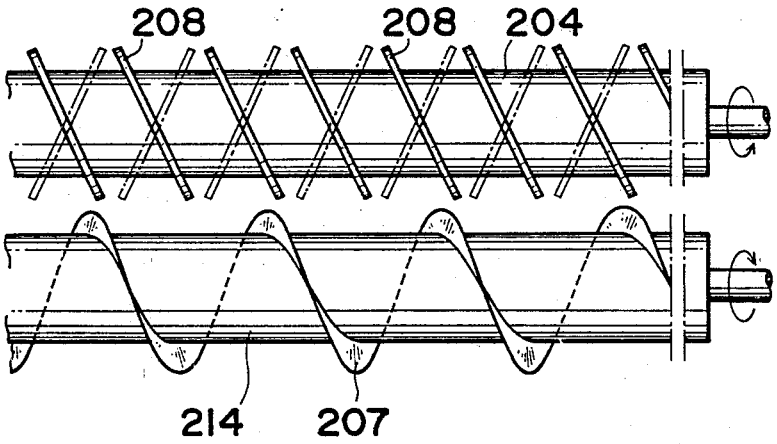
FIG. 21 is a view taken along the line C—C shown in FIG. 20.

Waste is transported toward the left in FIG. 21 when the phase angle of the rotating drum 204 varies from 0° to 180°, and toward the right in FIG. 21 when the phase angle of the rotating drum 204 varies from 180° to 360°.

Brackets 209 and 209 support bearings 205 and motors 206 and 216.

The operation of this embodiment is described hereinbelow. Waste thrown from the inlet 202 into the casing 201 is introduced between a pair of the rotating drums 204 and 214 because the rotating drums 204 and 214 rotate such that the upper surfaces thereof turn inward as shown in FIG. 21. Then, the waste is moved or transferred toward the right by the screw 207 mounted on the rotating drum 214. During this movement, the cutting disks 208 mounted on the rotating drum 204 apply force acting in the opposite direction to the waste until the rotating drum 204 has rotated for 180°. As a result, the waste is sandwiched between the screw 207 and the cutting disks 208, thereby being compressed and crushed.

When the rotating drum 204 has rotated for 180°, the positions of the cutting disks 208 are as shown by chain lines in FIG. 21. Thereafter the waste is transferred toward the right, the same direction in which the waste is transferred by the screw 207, until the rotating drum 204 has rotated for another 180° and the cutting disks 208 return to the positions shown by the solid lines. During this rotation the waste is not crushed.

It is possible, however, to crush the waste during that rotation, that is, at the phase angle of between 180° and 360° of the cutting drum 204, by rotating the rotating drums 204 and 214 at different speeds.

Even though stiff foreign matter is sandwiched between the cutting disks 208 and the screw 207 during operation thereof, the stiff foreign matter is discharged from the outlet 203 without harming the cutting disks and/or the screw. This is because the cutting disks 208 have flexibility because of their shape and when a cutting disk gets in contact with the stiff foreign matter, the cutting disk is deflected. When the rotating drums 204 or 214 rotate for more than 180°, the cutting disks 208 transfer the foreign matter in the same direction as the screw 207 does, so that the foreign matter is let loose and drops in the space between the rotating drums 204 and 214.

As described above, the crusher of this embodiment is provided with a pair of rotating drums 204 and 214 which rotate in opposite directions in the casing 201, the screw 207 mounted on the rotating drum 214, and a plurality of the cutting disks 208 mounted on the rotating drum 204 obliquely thereto. Accordingly, waste passing between the rotating drums 204 and 214 is crushed by the cutting disks 208 and the screw 207. Possible stiff foreign matter between the cutting disks 208 and the screw 207 are prevented from remaining therebetween because the direction of the obliqueness of the cutting disks 208 varies in accordance with the phase angle of the rotating drum 204.

As described above, according to the fourth embodiment, the rotating drums are not stopped during operation and the screw is not damaged. Thus, the working efficiency can be improved.

Fifth Embodiment

A fifth embodiment of the present invention is described with reference to FIGS. 22 through 27.

Figure 22:
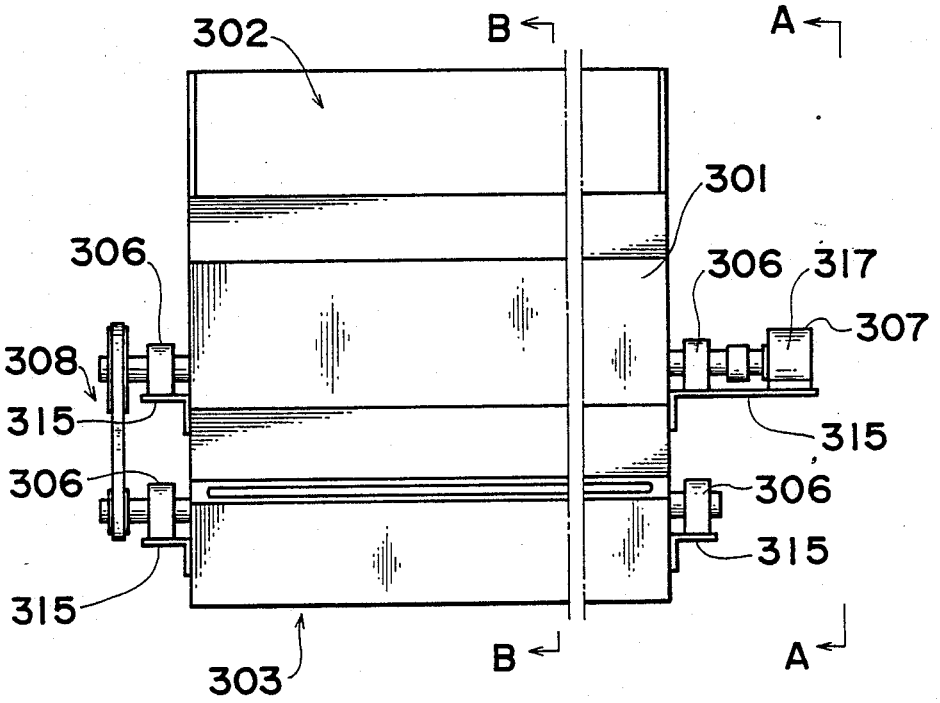
FIG. 22 is a front view of the crusher of a fifth embodiment of the present invention.
Figure 23:
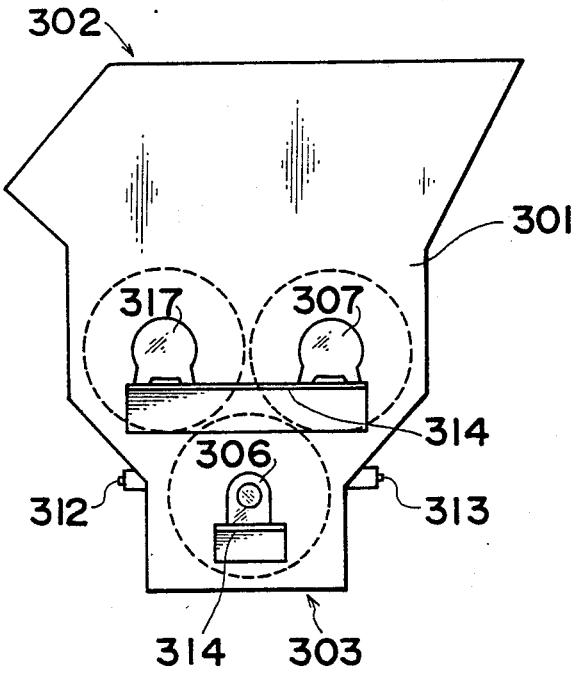
FIG. 23 is a view taken along the line A—A shown in FIG. 22.
Figure 25:
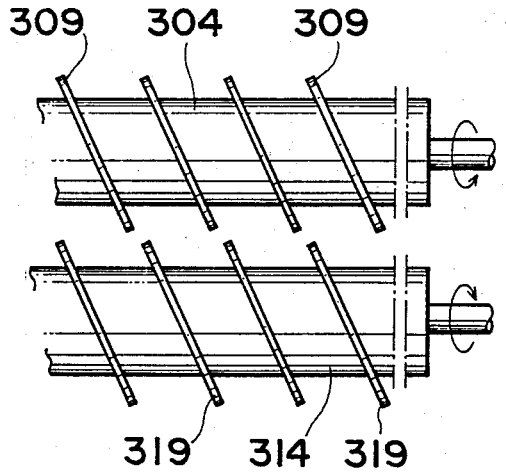
FIG. 25 is a view taken along the line C—C shown in FIG. 24.

Referring now to FIGS. 22, 23, there is shown a casing 301 which has an inlet 302 at an upper portion thereof and an outlet 303 at a lower portion thereof. Two rotating drums 304 and 314 serving as rotating members are provided in the casing 301 in such a manner that the rotating drums are arranged in parallel with each other and at the same level, and a further rotating drum 305 is provided below the rotating drums 304 and 314. The rotating drums 304, 314, and 305 are supported by respective bearings 306, and ends of the rotating drums 304 and 314 are coupled with motors 307 and 317, whereby the rotating drum 304 is rotated counterclockwise and the rotating drum 314 clockwise. The rotation of the rotating drum 314 is transmitted to the rotating drum 305 through a transmission member 308. As shown in FIG. 25, the upper rotating drums 304 and 314 are respectively provided with a plurality of cutting disks 309 and 319 arranged at predetermined intervals.

The cutting disks 309 and 319 are oblique with respect to the rotating drums 304 and 314, respectively. The cutting disks 309 and 319 apply force acting in opposite directions, i.e., shearing force, to waste through the rotations in the opposite directions of the rotating drums 304 and 314. The waste is compressed and crushed in the space between the cutting disks 309 and 319 by such shearing force.

Figure 26:
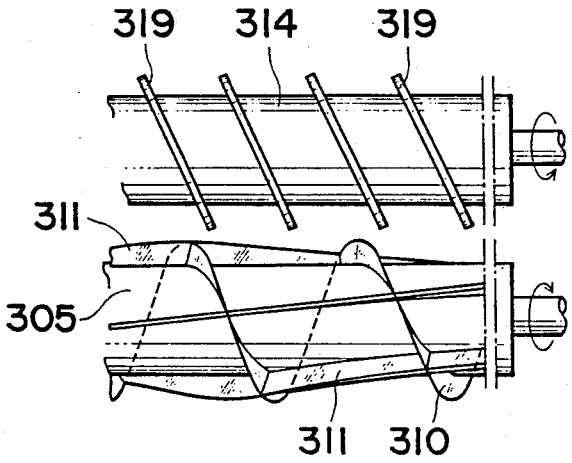
FIG. 26 is a view taken along the line D—D shown in FIG. 24.
Figure 27:
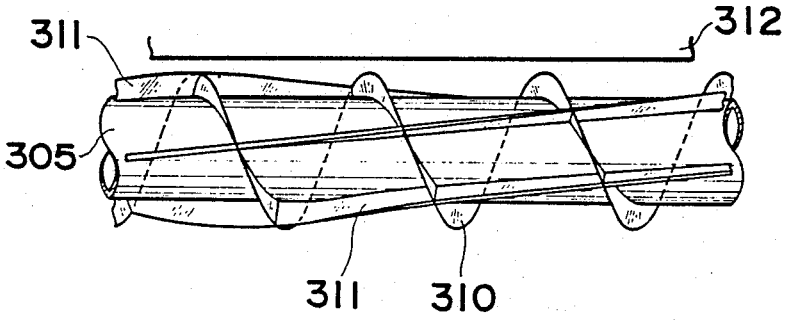
FIG. 27 is a view taken along the line E—E shown in FIG. 24.

Referring to FIGS. 26 and 27, a screw 310 is mounted on the outer circumferential surface of the lower rotating drum 305 and a plurality of blades 311 are also spirally fixed thereto in such a manner that the blades 311 intersect and are flush with the screw 310. The blades 311 helically run in a direction opposite to the direction in which the screw 310 turns. The helix angle of the blade 311 is much larger than that of the screw 310. Waste is compressed and crushed into large pieces by the screw 310 in cooperation with the cutting disks 319 mounted on the rotating drum 314.

A stationary blade 312 is fixed to the casing 301 so as to confront the rotating drum 305, the upper surface of which rotates towards the blade 312. This stationary blade compresses and crushes the waste once roughly crushed into small pieces in cooperation with the blades on the rotating drum 305. Since the helical angle of each of the blades 311 is large, that is, the angle between a blade 311 and the stationary blade 312 is small, the waste is easily and smoothly crushed.

A battle plate 313 prevents non-crushed waste from dropping below it. Brackets 315 support the bearings 306 and the motors 307 and 317.

In this embodiment, the blades 311 helically run in a direction opposite to the direction in which the screw 310 turns, but the former may run in the same direction as that of the screw 310 under the condition of a large helix angle. In this case, similar efficiency can be also obtained.

The operation of this embodiment is described hereinbelow.

Figure 24:
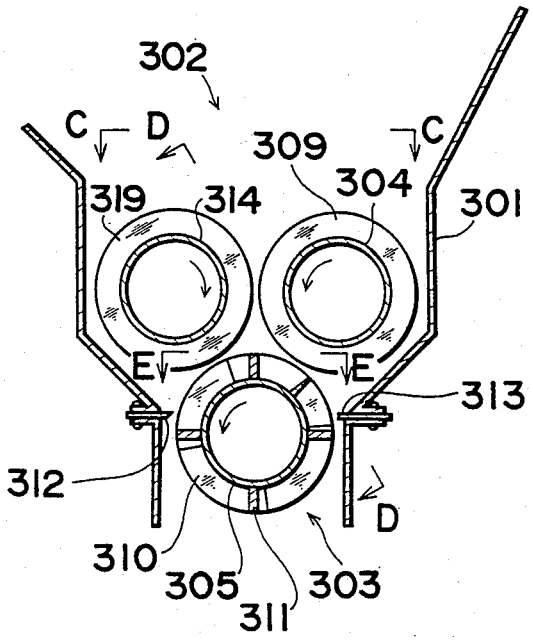
FIG. 24 is a cross-sectional view taken along the line B—B shown in FIG. 22.

Waste thrown into the casing 301 from the inlet 302 is introduced between the rotating drums 204 and 214, compressed and roughly crushed by the cutting disks 309 and 319 mounted on the respective rotating drums 304 and 314 rotating in the opposite directions shown by the arrows in FIG. 24. (See the first embodiment to understand the crushing principle of the cutting disks.)

The waste crushed into comparatively large fragments passes through the space between the upper and lower rotating drums 314 and 304 because the rotating drum 305 is rotating in the direction shown by the arrow in FIG. 24. At this time, the waste is further crushed by the cutting disks 319 and the screw 310 and also by the cutting disks 319 and the blades 310 which gently incline with respect to the axis of the rotating drum 305.

When the roughly crushed waste is introduced toward the stationary blade 312 owing to the directions of rotation of the upper and lower rotating drums 314 and 305, the waste is further crushed into small fragments by the stationary blade 312 and the blades 311. Even though any waste fragment slides down the blade 311, the screw 310 stops the slide. Therefore, the fragment can be reliably crushed into fine pieces.

Three rotating drums are used to perform a crushing operation in this embodiment. However, the advantage of this embodiment can be obtained even when only one upper rotating drum 304 or 314 is used.

As described above, a plurality of cutting disks are mounted on at least one rotating drum with certain inclination with respect to the axis thereof, while blades 311 and a screw 310 are mounted on the other rotating drum. A crushing operation is carried out by the cutting disks and the screw and the blades first. Then, further crushing operation is effected by the blades and a stationary blade which is fixed to a casing so as to confront the other rotating drum. The crushing operation consists of two stages, one for crushing waste into large pieces and the other for crushing the large pieces into smaller pieces. In both stages of the crushing operation the other rotating drum functions, so that a crusher of the present embodiment can be compact. Further, because the number of components of the crusher can be reduced owing to the multifunction of one of the rotating drums, troubles or failures do not occur so often and in addition, such a crusher can be manufactured at a low cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for crushing things comprising:

a casing having an inlet and an outlet;

a plurality of rotating members rotatably mounted in the casing, axes of rotation thereof being in parallel with each other;

means for rotating the rotating members;

a plurality of cutting disks obliquely fixed to an outer circumferential surface of at least a first one of the rotating members at predetermined regular intervals so as to have a predetermined inclination other than 90° with respect to the axis of the first rotating member such that the cutting disks are spaced-apart and parallel to each other, each of said cutting disks consisting of an annulus having an entirely circular outer peripheral edge;

a screw fixed to an outer circumferential surface of a second one of the members; and blades fixed to the outer circumferential surface of the second rotating member extending helically on said second rotating member about the rotation axis thereof, and intersecting the screw, and a stationary blade having a cutting edge extending parallel to the rotation axis of the second rotating member and being fixed to an inner surface of the casing so as to confront the second rotating member;

whereby a crushing operation is performed by the cutting disks and the screw, followed by a further crushing operation performed by the blades on the second rotating member and the stationary blade.

2. The apparatus as claimed in claim 1, wherein the screw has a helical pitch which is smaller than a helical pitch of the blades.

3. The apparatus as claimed in claim 2, wherein the screw helically extends about the axis of rotation of the second rotating member in a direction opposite to a direction in which the blades helically extend about the axis of rotation of the second rotating member.

4. The apparatus as claimed in claim 1, wherein radially outer surfaces of the screw and blades are flush with each other where the blades intersect the screw.

* * * * *